US011459908B2

(12) United States Patent
Decesare et al.

(10) Patent No.: US 11,459,908 B2
(45) Date of Patent: Oct. 4, 2022

(54) CMC COMPONENT INCLUDING DIRECTIONALLY CONTROLLABLE CMC INSERT AND METHOD OF FABRICATION

(71) Applicant: General Electric Company, Schenectady, NY (US)

(72) Inventors: Douglas Glenn Decesare, Queensbury, NY (US); Daniel Gene Dunn, Guilderland, NY (US)

(73) Assignee: General Electric Company, Schenectady, NY (US)

( * ) Notice: Subject to any disclaimer, the term of this patent is extended or adjusted under 35 U.S.C. 154(b) by 144 days.

(21) Appl. No.: 16/119,142

(22) Filed: Aug. 31, 2018

(65) Prior Publication Data

US 2020/0072078 A1 Mar. 5, 2020

(51) Int. Cl.
*F01D 25/00* (2006.01)
*F01D 5/28* (2006.01)

(52) U.S. Cl.
CPC ..... *F01D 25/005* (2013.01); *F01D 5/282* (2013.01); *F05D 2230/31* (2013.01);
(Continued)

(58) Field of Classification Search
CPC ..... Y10T 428/20; Y10T 428/249928; Y10T 428/249929; B32B 5/02; B32B 5/12; B32B 18/00; B32B 2262/105; B32B 2305/07; B32B 2315/02; B32B 2605/18; F01D 5/005; F01D 25/005; F01D 5/282; B23B 5/076; B29K 2309/02; B29K 2509/02; B29K 2709/02; B23P 6/002; B23P 6/04; B23P 6/045; F05D 2230/31;
(Continued)

(56) References Cited

U.S. PATENT DOCUMENTS 3,066,400 A 12/1962 Forsythe
3,700,517 A 10/1972 Roach
(Continued)

FOREIGN PATENT DOCUMENTS

WO WO2018/005105 A1 1/2018

OTHER PUBLICATIONS

"Composite Repair", Hexcel Composites, Apr. 1999, pp. 1-13. (Year: 1999).*
(Continued)

*Primary Examiner* — Ehud Gartenberg
*Assistant Examiner* — David P. Olynick
(74) *Attorney, Agent, or Firm* — Dority & Manning, P.A.

(57) ABSTRACT

A ceramic matrix composite (CMC) component including a plurality of layers of a CMC and a directionally controllable CMC insert. The directionally controllable CMC insert is disposed in the plurality of layers of a ceramic matrix composite. The directionally controllable CMC insert includes an optimized architecture to strengthen a high stress region of the CMC component. The directionally controllable CMC insert is geometrically configured and disposed within the plurality of layers of the CMC to redirect a crack in the CMC component toward a region of low crack growth driving force. A turbomachine and method of forming a turbomachine member including a plurality of layers of a CMC and having the directionally controllable CMC insert disposed in a shaped void are additionally disclosed.

19 Claims, 7 Drawing Sheets

(52) U.S. Cl.
CPC ..... *F05D 2230/80* (2013.01); *F05D 2240/11* (2013.01); *F05D 2240/12* (2013.01); *F05D 2240/14* (2013.01); *F05D 2240/24* (2013.01); *F05D 2240/35* (2013.01); *F05D 2300/603* (2013.01)

(58) Field of Classification Search
CPC ..... F05D 2240/11; F05D 2240/12; F05D 2240/14; F05D 2240/24; F05D 2240/35; F05D 2300/603
USPC ..... 428/293.4, 293.7
See application file for complete search history.

(56) References Cited

U.S. PATENT DOCUMENTS 4,916,880 A * 4/1990 Westerman, Jr. ..... B29C 73/04 156/94
5,341,554 A 8/1994 Diperstein
5,606,796 A * 3/1997 Fraser ..... B23K 9/04 228/119
5,958,166 A * 9/1999 Walters ..... B29C 73/32 156/94
6,715,365 B2 4/2004 Davey
6,820,334 B2 * 11/2004 Kebbede ..... C04B 41/87 29/889.1
7,810,237 B2 10/2010 Lange et al.
8,524,020 B2 * 9/2013 Lindgren ..... B23Q 17/20 156/64
8,540,909 B2 * 9/2013 Dan-Jumbo ..... B32B 19/04 264/36.1
8,568,545 B2 * 10/2013 Lindgren ..... G05B 19/402 156/64
8,726,610 B2 5/2014 Johnston et al.
8,763,229 B2 7/2014 Reid et al.
9,115,584 B2 8/2015 Roberts et al.
9,327,446 B2 * 5/2016 Clark ..... B29C 66/1122
9,545,774 B1 * 1/2017 Heng ..... C04B 37/005
9,657,489 B2 5/2017 Harper
11,028,696 B2 * 6/2021 Roberts ..... F01D 5/147
2008/0025842 A1 1/2008 Marini et al.
2014/0082912 A1 3/2014 Narayanachar et al.
2014/0272248 A1 * 9/2014 Chamberlain ..... C04B 35/803 428/63
2016/0356499 A1 * 12/2016 Freeman ..... F23R 3/007
2016/0376893 A1 * 12/2016 Hardwicke ..... C04B 37/005 156/249
2017/0022833 A1 1/2017 Heitman et al.
2018/0002238 A1 1/2018 Hockemeyer et al.

OTHER PUBLICATIONS

Gacoin Comparison between experimental and numerical study of the adhesively bonded scarf joint and double scarf joint: Influence of internal singularity created by geometry of the double scarf joint on the damage evolution. International Journal of Adhesion & Adhesives 29, pp. 572-579, Feb. 2009 (Year: 2009).*
Baker, "Repair Techniques for Composite Structures", Composite Materials in Aircraft Structures, Jan. 1, 1990, pp. 207-227. (Year: 1990).*
Robert W. Messler, Jr, "Joining Composite Materials and Structures: Some Thought-provoking Possibilities," Journal of Thermoplastic Composite Materials, vol. 17—Jan. 2004, 51-74 (Year: 2004).*
K.B. Katnam, L.F.M.DaSilva, T.M.Young, "Bonded repair of composite aircraft structures:A review of scientific challenges and opportunities," ProgressinAerospaceSciences61(2013)26-42 (Year: 2013).*
Brun, Milivoj K., Formation of Tough Composite Joints, Journal of the American Ceramic Society, Dec. 1998, vol. 81, No. 12, pp. 3307-3312.
Corman, G. S., & Luthra, K. L., Melt Infiltrated Ceramic Composites (HiperComp) for Gas Turbine Engine Applications, Jan. 2006, Continuous Fiber Ceramic Composites Program Phase II Final Report for the Period May 1994-Sep. 2005, Chapter 3.3 Composite Joining, Table of Contents and Pages i-iv and 97-114.
European Search Report Corresponding to Application No. 19192830 dated Jan. 28, 2020.

* cited by examiner

CMC COMPONENT INCLUDING DIRECTIONALLY CONTROLLABLE CMC INSERT AND METHOD OF FABRICATION

BACKGROUND

The subject matter disclosed herein relates to ceramic matrix composite (CMC) components and the manufacture or repair of such components. More particularly, this disclosure is directed to CMC inserts for use in controlling cracks in CMC components and a method of controlling cracks formed in a CMC component.

Gas turbine engines feature several components. Air enters the engine and passes through a compressor. The compressed air is routed through one or more combustors. Within a combustor are one or more nozzles that serve to introduce fuel into a stream of air passing through the combustor. The resulting fuel-air mixture is ignited in the combustor by igniters to generate hot, pressurized combustion gases in the range of about 1100° C. to 2000° C. This high energy airflow exiting the combustor is redirected by the first stage turbine nozzle to downstream high and low pressure turbine stages. The turbine section of the gas turbine engine contains a rotor shaft and one or more turbine stages, each having a turbine disk (or rotor) mounted or otherwise carried by the shaft and turbine blades mounted to and radially extending from the periphery of the disk. A turbine assembly typically generates rotating shaft power by expanding the high energy airflow produced by combustion of fuel-air mixture. Gas turbine buckets or blades generally have an airfoil shape designed to convert the thermal and kinetic energy of the flow path gases into mechanical rotation of the rotor. In these stages, the expanded hot gases exert forces upon turbine blades, thus providing additional rotational energy to, for example, drive a power-producing generator.

In advanced gas path (AGP) heat transfer design for gas turbine engines, the high temperature capability of CMCs make it an attractive material from which to fabricate arcuate components such as turbine blades, nozzles and shrouds.

A number of techniques have been used to manufacture turbine engine components such as the turbine blades, nozzles or shrouds using CMC. CMC materials generally comprise a ceramic fiber reinforcement material embedded in a ceramic matrix material. The reinforcement material serves as the load-bearing constituent of the CMC in the event of a matrix crack; the ceramic matrix protects the reinforcement material, maintains the orientation of its fiber, and carries load in the absence of matrix cracks. Of particular interest to high-temperature applications, such as in a gas turbine engine, are silicon-based composites. Silicon carbide (SiC)-based CMC materials have been proposed as materials for certain components of gas turbine engines, such as the turbine blades, vanes, combustor liners, and shrouds. SiC fibers have been used as a reinforcement material for a variety of ceramic matrix materials, including SiC, C, and $Al_2O_3$. Various methods are known for fabricating SiC-based CMC components, including Silicomp, melt infiltration (MI), chemical vapor infiltration (CVI), polymer infiltration and pyrolysis (PIP). In addition to non-oxide based CMCs such as SiC, there are oxide based CMCs. Though these fabrication techniques significantly differ from each other, each involves the fabrication and densification of a preform to produce a part through a process that includes the application of heat at various processing stages.

As previously stated, CMC components, such as CMC blades, nozzles and shrouds, are known for use high-temperature applications. During normal use in such high-temperature applications, or when operating the CMC components above their proportional limit, defects, in the form of cracks, may develop in high stress/strain regions and premature replacement is likely.

Thus, an improved CMC component of a gas turbine engine and method or fabricating or repairing a damaged CMC component with locally optimized architecture, so as to steer future crack(s) into low crack growth regions is desired. The resulting CMC component provides simplification of the repair/replacement costs and prevents the re-initiation of localized damage material.

BRIEF DESCRIPTION

Various embodiments of the disclosure include CMC component including a directionally controllable CMC insert and method of fabrication. In accordance with one exemplary embodiment, disclosed is a ceramic matrix composite (CMC) component including a plurality of layers of a CMC and a directionally controllable CMC insert disposed in the plurality of layers of a ceramic matrix composite. The directionally controllable CMC insert includes optimized architecture to strengthen a high stress region of the CMC component. The directionally controllable CMC insert is geometrically configured and disposed within the plurality of layers of the CMC to redirect a crack in the CMC component toward a region of low crack growth driving force.

In accordance with another exemplary embodiment, disclosed is a turbomachine including a CMC component comprised of a plurality of CMC material layers and including a shaped void contained therein the plurality of CMC material layers and a directionally controllable CMC insert disposed within the shaped void. The directionally controllable CMC insert includes optimized architecture to strengthen a high stress region of the CMC component. The shaped void and the directionally controllable CMC insert are geometrically configured to form a mechanical interlocking joint therebetween and to redirect a crack in the CMC component toward a region of low crack growth driving force.

In accordance with yet another exemplary embodiment, disclosed is a method of forming a turbomachine member. The method including removing a portion of the plurality of CMC material layers in a desired shape to form a shaped void in a plurality of CMC material layers and disposing a directionally controllable CMC insert into the shaped void formed in the plurality of CMC material layers. The directionally controllable CMC insert is geometrically shaped to form a joint with the shaped void. The directionally controllable CMC insert comprises optimized architecture to strengthen a high stress region of the turbomachine member. The directionally controllable CMC insert is geometrically configured and disposed within the turbomachine member to redirect a crack in the turbomachine member toward a region of low crack growth driving force.

Other objects and advantages of the present disclosure will become apparent upon reading the following detailed description and the appended claims with reference to the accompanying drawings. These and other features and improvements of the present application will become apparent to one of ordinary skill in the art upon review of the following detailed description when taken in conjunction with the several drawings and the appended claims.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
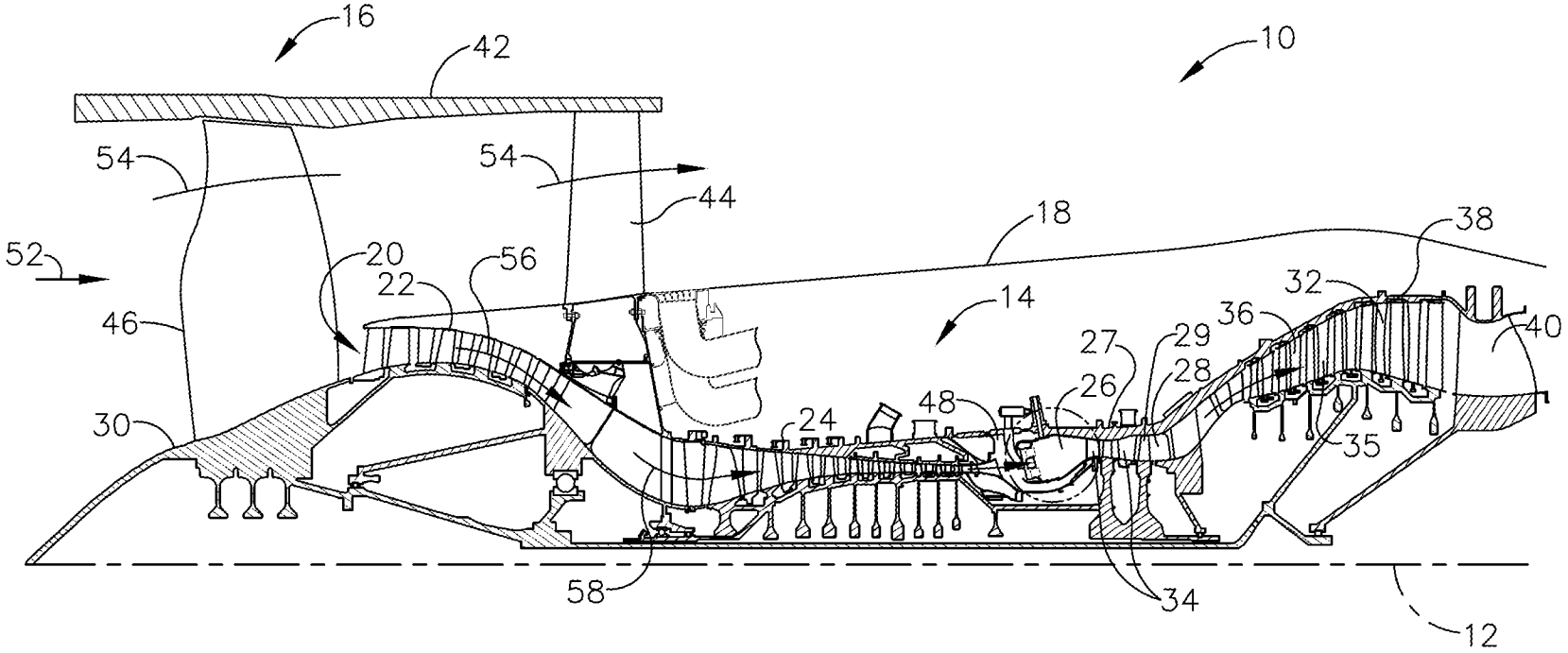
FIG. 1 is a cross sectional view of an aviation gas turbine engine, in accordance with one or more embodiments shown or described herein, in accordance with one or more embodiments shown or described herein.

The detailed description explains embodiments of the disclosure, together with advantages and features, by way of example with reference to the drawings.

DETAILED DESCRIPTION

Reference now will be made in detail to embodiments of the disclosure, one or more examples of which are illustrated in the drawings. Each example is provided by way of explanation of the disclosure, not limitation of the disclosure. In fact, it will be apparent to those skilled in the art that various modifications and variations can be made in the present disclosure without departing from the scope or spirit of the disclosure. For instance, features illustrated or described as part of one embodiment can be used with another embodiment to yield a still further embodiment. Thus, it is intended that the present disclosure covers such modifications and variations as come within the scope of the appended claims and their equivalents.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Approximating language, as used herein throughout the specification and claims, is applied to modify any quantitative representation that could permissibly vary without resulting in a change in the basic function to which it is related. Unless otherwise indicated, approximating language, such as "generally," "substantially," and "about," as used herein indicates that the term so modified may apply to only an approximate degree, as would be recognized by one of ordinary skill in the art, rather than to an absolute or perfect degree. Accordingly, a value modified by such term is not to be limited to the precise value specified. In at least some instances, the approximating language may correspond to the precision of an instrument for measuring the value. Here and throughout the specification and claims, range limitations are combined and interchanged. Such ranges are identified and include all the sub-ranges contained therein unless context or language indicates otherwise.

Additionally, unless otherwise indicated, the terms "first," "second," etc. are used herein merely as labels, and are not intended to impose ordinal, positional, or hierarchical requirements on the items to which these terms refer. Moreover, reference to, for example, a "second" item does not require or preclude the existence of, for example, a "first" or lower-numbered item or a "third" or higher-numbered item.

As used herein, ceramic matrix composite or "CMCs" refers to composites comprising a ceramic matrix reinforced by ceramic fibers. Some examples of CMCs acceptable for use herein can include, but are not limited to, materials having a matrix and reinforcing fibers comprising oxides, carbides, nitrides, oxycarbides, oxynitrides and mixtures thereof. Examples of non-oxide materials include, but are not limited to, CMCs with a silicon carbide matrix and silicon carbide fiber (when made by silicon melt infiltration, this matrix will contain residual free silicon); silicon carbide/silicon matrix mixture and silicon carbide fiber; silicon nitride matrix and silicon carbide fiber; and silicon carbide/silicon nitride matrix mixture and silicon carbide fiber. Furthermore, CMCs can have a matrix and reinforcing fibers comprised of oxide ceramics. Specifically, the oxide-oxide CMCs may be comprised of a matrix and reinforcing fibers comprising oxide-based materials such as aluminum oxide ($Al_2O_3$), silicon dioxide ($SiO_2$), aluminosilicates, and mixtures thereof. Accordingly, as used herein, the term "ceramic matrix composite" includes, but is not limited to, carbon-fiber-reinforced carbon (C/C), carbon-fiber-reinforced silicon carbide (C/SiC), and silicon-carbide-fiber-reinforced silicon carbide (SiC/SiC). In one embodiment, the ceramic matrix composite material has increased elongation, fracture toughness, thermal shock, and anisotropic properties as compared to a (non-reinforced) monolithic ceramic structure.

There are several methods that can be used to fabricate SiC—SiC CMCs. In one approach, the matrix is partially formed or densified through melt infiltration (MI) of molten silicon or silicon containing alloy into a CMC preform. In another approach, the matrix is at least partially formed through chemical vapor infiltration (CVI) of silicon carbide into a CMC preform. In a third approach, the matrix is at least partially formed by pyrolizing a silicon carbide yielding pre-ceramic polymer. This method is often referred to as polymer infiltration and pyrolysis (PIP). Combinations of the above three techniques can also be used.

In one example of the MI CMC process, a boron-nitride based coating system is deposited on SiC fiber. The coated fiber is then impregnated with matrix precursor material in order to form prepreg tapes. One method of fabricating the tapes is filament winding. The fiber is drawn through a bath of matrix precursor slurry and the impregnated fiber wound on a drum. The matrix precursor may contain silicon carbide and or carbon particulates as well as organic materials. The impregnated fiber is then cut along the axis of the drum and is removed from the drum to yield a flat prepreg tape where the fibers are nominally running in the same direction. The resulting material is a unidirectional prepreg tape. The prepreg tapes can also be made using continuous prepregging machines or by other means. The tape can then be cut into shapes, layed up, and laminated to produce a preform. The preform is pyrolyzed, or burned out, in order to char any organic material from the matrix precursor and to create porosity. Molten silicon is then infiltrated into the porous preform, where it can react with carbon to form silicon carbide. Ideally, excess free silicon fills any remaining porosity and a dense composite is obtained. The matrix produced in this manner typically contains residual free silicon.

The prepreg MI process generates a material with a two-dimensional fiber architecture by stacking together multiple one-dimensional prepreg plies where the orientation of the fibers is varied between plies. Plies are often identified based on the orientation of the continuous fibers. A zero degree orientation is established, and other plies are designed based on the angle of their fibers with respect to the zero degree direction. Plies in which the fibers run perpendicular to the zero direction are known as 90 degree plies, cross plies, or transverse plies.

The MI approach can also be used with two-dimensional or three-dimensional woven architectures. An example of this approach would be the slurry-cast process, where the fiber is first woven into a three-dimensional preform or into a two-dimensional cloth. In the case of the cloth, layers of cloth are cut to shape and stacked up to create a preform. A chemical vapor infiltration (CVI) technique is used to deposit the interfacial coatings (typically boron nitride based or carbon based) onto the fibers. CVI can also be used to deposit a layer of silicon carbide matrix. The remaining portion of the matrix is formed by casting a matrix precursor slurry into the preform, and then infiltrating with molten silicon.

An alternative to the MI approach is to use the CVI technique to densify the Silicon Carbide matrix in one-dimensional, two-dimensional or three-dimensional architectures. Similarly, PIP can be used to densify the matrix of the composite. CVI and PIP generated matrices can be produced without excess free silicon. Combinations of MI, CVI, and PIP can also be used to densify the matrix.

The directionally controllable CMC insert described herein can be used in conjunction with any load bearing CMC structural design, such as those described in U.S. Publication No. 2017/0022833, by Heitman, B. et al. (hereinafter referred to as Heitman), filed on Jul. 24, 2015, and titled, "METHOD AND SYSTEM FOR INTERFACING A CERAMIC MATRIX COMPOSITE COMPONENT TO A METALLIC COMPONENT", which is incorporated herein in its entirety. More specifically, wherein the overall composite shape and geometry of various components are described in the disclosure of Heitman, this disclosure includes various methods of manufacturing or repairing a crack in the CMC component material with a directionally controllable CMC insert.

In particular, the directionally controllable CMC inserts described herein can be used in the initial manufacture or repair of components formed of various CMC materials. The directionally controllable CMC inserts can be used in the initial manufacture or repair of components and/or subcomponents that are all MI based, that are all CVI based, that are all PIP based, or that are combinations thereof. The directionally controllable insert may not be direct bonded to the local component in which it is disposed, or may be bonded by silicon, silicon carbide, a combination thereof, or other suitable material. The bonding material may be deposited as a matrix precursor material that is subsequently densified by MI, CVI, or PIP. Alternatively, the bonding material maybe produced by MI, CVI, or PIP without the use of matrix precursor. Furthermore, the directionally controllable CMC inserts described herein may be comprised of green prepreg, laminated preforms, pyrolyzed preforms, fully densified preforms, or combinations thereof.

Referring now to the drawings wherein like numerals correspond to like elements throughout, attention is directed initially to FIG. 1 which depicts in diagrammatic form an exemplary gas turbine engine 10 utilized with aircraft having a longitudinal or axial centerline axis 12 therethrough for reference purposes. It should be understood that the principles described herein are equally applicable to turbofan, turbojet and turboshaft engines, as well as turbine engines used for other vehicles or in stationary applications. In an effort to provide a concise description of these embodiments, not all features of an actual implementation are described in the specification. Furthermore, while a portion of a turbine nozzle is used as an example, the principles of the present disclosure are applicable to any low-ductility flowpath component which is at least partially exposed to a primary combustion gas flowpath of a gas turbine engine and formed of a ceramic matrix composite (CMC) material, and more particularly, any airfoil-platform-like structure, such as, but not limited to, blades, tip-shrouds, or the like.

Engine 10 preferably includes a core gas turbine engine generally identified by numeral 14 and a fan section 16 positioned upstream thereof. Core engine 14 typically includes a generally tubular outer casing 18 that defines an annular inlet 20. Outer casing 18 further encloses a booster compressor 22 for raising the pressure of the air that enters core engine 14 to a first pressure level. A high pressure, multi-stage, axial-flow compressor 24 receives pressurized air from booster 22 and further increases the pressure of the air. The pressurized air flows to a combustor 26, where fuel is injected into the pressurized air stream to raise the temperature and energy level of the pressurized air. The high energy combustion products flow from combustor 26 to a first high pressure (HP) turbine 28 for driving high pressure compressor 24 through a first HP drive shaft, and then to a second low pressure (LP) turbine 32 for driving booster compressor 22 and fan section 16 through a second LP drive shaft that is coaxial with first drive shaft. The HP turbine 28 includes a HP stationary nozzle 34. The LP turbine 32 includes a stationary LP nozzle 35. A rotor disk is located downstream of the nozzles that rotates about the centerline axis 12 of the engine 10 and carries an array of airfoil-shaped turbine blades 36. Shrouds 29, 38, comprising a plurality of arcuate shroud segments, are arranged so as to encircle and closely surround the turbine blades 27, 36 and thereby define the outer radial flowpath boundary for the hot gas stream flowing through the turbine blades 27, 36. After driving each of the turbines 28 and 32, the combustion products leave core engine 14 through an exhaust nozzle 40.

Fan section 16 includes a rotatable, axial-flow fan rotor 30 and a plurality of fan rotor blades 46 that are surrounded by an annular fan casing 42. It will be appreciated that fan casing 42 is supported from core engine 14 by a plurality of substantially radially-extending, circumferentially-spaced outlet guide vanes 44. In this way, fan casing 42 encloses fan rotor 30 and the plurality of fan rotor blades 46.

From a flow standpoint, it will be appreciated that an initial air flow, represented by arrow 50, enters gas turbine engine 10 through an inlet 52. Air flow 50 passes through fan blades 46 and splits into a first compressed air flow (represented by arrow 54) that moves through the fan casing 42 and a second compressed air flow (represented by arrow 56) which enters booster compressor 22. The pressure of second compressed air flow 56 is increased and enters high pressure compressor 24, as represented by arrow 58. After mixing with fuel and being combusted in combustor 26, combustion products 48 exit combustor 26 and flow through first turbine 28. Combustion products 48 then flow through second turbine 32 and exit exhaust nozzle 40 to provide thrust for gas turbine engine 10.

Many of the engine components may be directly subjected to hot combustion gases during operation of the engine 10 and thus have very demanding material requirements. Accordingly, many of the components of the engine 10 are fabricated from ceramic matrix composites (CMCs) as a singular piece, or fabricated in more than one piece and subsequently joined together. As previously stated, of particular concern herein are CMC components, such as turbine nozzle bands, nozzle, shrouds, or the like that during use in such high-temperature applications exceed their proportional limit and thus cracks may develop in high stress/strain regions. In a preferred embodiment, the directionally controllable CMC inserts described herein provide repair of existing defects/cracks, provide controlled steering of future crack formation into low crack growth regions and are locally optimized to strengthen high stress/strain locations. The directionally controllable CMC inserts may have locally optimized architecture specifically designed for repairing damaged CMC material, but may be utilized during initial fabrication to prevent crack formation.

In joining the directionally controllable CMC insert to the local component material, it may be desirable to form joints that are damage tolerant and exhibit tough, graceful failure. To provide such, the directionally controllable CMC insert may include mechanical interlocking features to provide an interlocking mechanical joint that joins the directionally controllable CMC insert and the local material. The interlocking feature or features can retain the insert in the CMC component in one or more directions. The direction of the retention may be oriented to protect against loads that caused the crack that is being repaired. Alternatively, the retention may be oriented to protect against loads in directions other than that which caused the crack that is being repaired.

Of particular importance for the joint(s) formed between the directionally controllable inserts and the local component material is that the bond line tends to be brittle in nature, which could lead to brittle failure of the interlocking mechanical joint. It has been established in the CMC art that this limitation can be addressed by keeping the stress in the bond low by controlling the surface area of the bond and by making use of simple woodworking type joints such as butt joints, lap joints, tongue and groove joints, mortise and tenon joints, as well as more elaborate sawtooth or stepped tapered joints. Conventional woodworking joints such as dovetail joints have been demonstrated. While many woodworking type joints can create a mechanical interlock between two CMC subcomponents, in order for the interlock to take advantage of the full toughness of the CMC, the interlocking feature(s) must be oriented such that the reinforcing fibers would be required to break in order to fail the interlock. If the interlocking feature is oriented such that the interlocking mechanical joint can be liberated by failing one of the CMC subcomponents in the interlaminar direction, then toughness of the interlock may be limited by the interlaminar properties of the CMC. In general, the interlaminar strength and toughness of CMCs are significantly lower than the in-plane properties. Therefore, the location of the interface between the insert and the CMC component should be chosen to be in a low stress location to prevent failure of the bond. In the event of bond line failure, the shape of the insert should be such that a crack propagating along the interface will be steered into a low stress region with low driving force for crack propagation, such that the crack growth will arrest.

As previously stated, when one or more of the directionally controllable inserts are being used to repair a local component, the repair can be done in the prepreg, laminated, pyrolyzed, or fully densified state of the CMC. For repairs made in the MI state, the joint between the directionally controllable insert and the local material maybe left "unglued".

Figure 2:
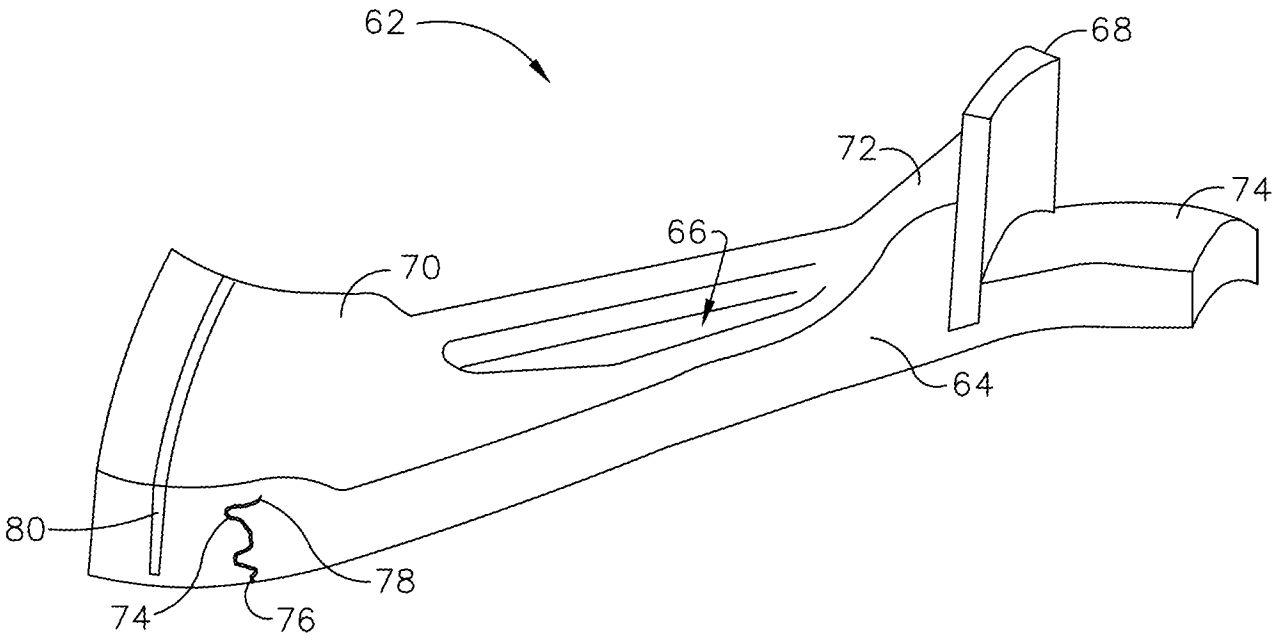
FIG. 2 is a partial perspective view of a portion of a turbomachine (a gas turbine nozzle band) including a directionally controllable CMC insert with mechanical interlock, in accordance with one or more embodiments shown or described herein.

Referring now to FIG. 2, illustrated in a simplified perspective view is a portion of turbine nozzle 60, such as nozzle 34 of FIG. 1, and more particularly a portion of the load bearing component of the nozzle 34. The nozzle 34 is generally comprised of a plurality of vanes (not shown) and a plurality of bands 62, of which only a portion of a single band is shown in FIG. 2. In exemplary embodiments, each of the plurality of vanes extends between a plurality of bands 62 and engages with one or more of the bands 62.

It should be understood that while a nozzle generally comprised of a plurality of vanes and a plurality of bands is described throughout this disclosure, the description provided is applicable to any type of structure comprised of one or more CMC components such as, but not limited to a combustor liner, a shroud, a turbine center frame, or the like. Accordingly, as described below, a described local CMC component is not limited to a band flowpath.

Referring again to FIG. 2, each of the plurality of bands 62 is defined by a band flowpath 64 having an opening 66 formed therein. The opening 66 is configured to engage with a vane (not shown) and provide a cooling medium (not shown) to flow into a cavity of the vane that is coupled thereto, as is generally known in the art. Each of the plurality of bands 62 is further defined by a load bearing wall 68. As best illustrated in FIG. 2, the load bearing wall 68 is positioned substantially perpendicular relative to the band flowpath 64. In the illustrated embodiment, a surface 70 of the band flowpath 64 is contoured. In alternate embodiment, the band flowpath 64 may be configured substantially planar.

During operation, an applied bearing load (i.e. mechanical or aero) is exerted on the band 62. In addition, during operation, the band 62 is subjected to thermal load cycles. Occasionally, any of the mechanical, aero or thermal load cycles, as well as foreign object damage, may lead to development of defects, such as fissures or cracks in the component. As best shown in FIG. 2, a crack 74 is shown in the band flowpath 64. Crack 74 includes a first end 76 and extends across a portion of the band flowpath 64 to a second end 78. Continued operation of turbomachine 10 (FIG. 1) may lead to crack propagation, or a shifting of second end 78, further along the band flowpath 64. Accordingly, it is desirable to repair the crack and prevent the formation of additional defects/cracks and propagation of such, in an attempt to avoid costly down time for extensive repair and/or replacement of the band 62. In accordance with an exemplary embodiment, provided is method by which crack repair and prevention is achieved by inserting a directionally controllable CMC insert, such as directionally controllable CMC insert 80, to substantially limit crack formation, and provide steering of a crack in the event of subsequent crack formation.

Referring now to FIGS. 3-8 and 13, illustrated is a method 100 of repairing a defect 102 in a CMC component 104, generally similar to crack 74 in the band flowpath 64 of FIG. 2. In the illustrated method 100, only a portion of the CMC component 104 is illustrated. As previously stated, the CMC component 104 is representative of any well-known components of a gas turbine engine, such as the turbine blades, vanes, bands, combustor liners, center frame, shrouds, etc. In addition, it should be understood that while a specific geometric shape for a directionally controllable insert is illustrated in FIGS. 3-8, any number of geometric shapes may be utilized, such as those illustrated in FIGS. 9-12, that provides for steering any future crack formation into low crack growth regions of the CMC component 104.

Figure 3:
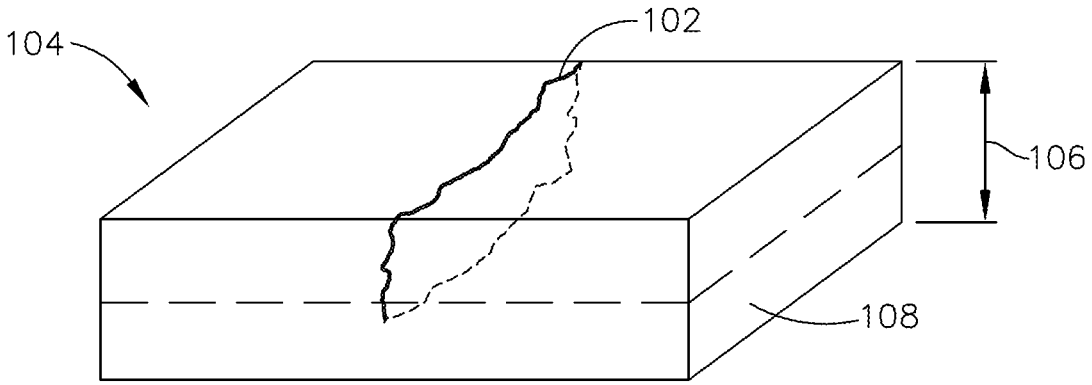
FIG. 3 illustrates a step in a method of repairing a crack with a directionally controllable CMC insert with mechanical interlock, in accordance with one or more embodiments shown or described herein.
Figure 4:
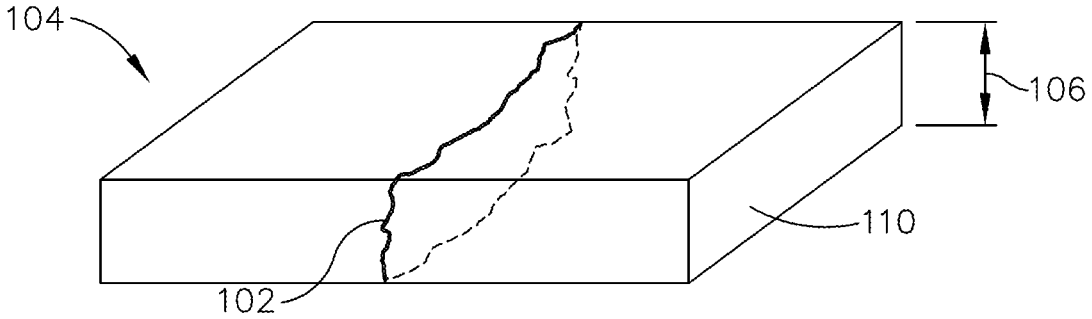
FIG. 4 illustrates a step in a method of repairing a crack with a directionally controllable CMC insert with mechanical interlock, in accordance with one or more embodiments shown or described herein.
Figure 13:
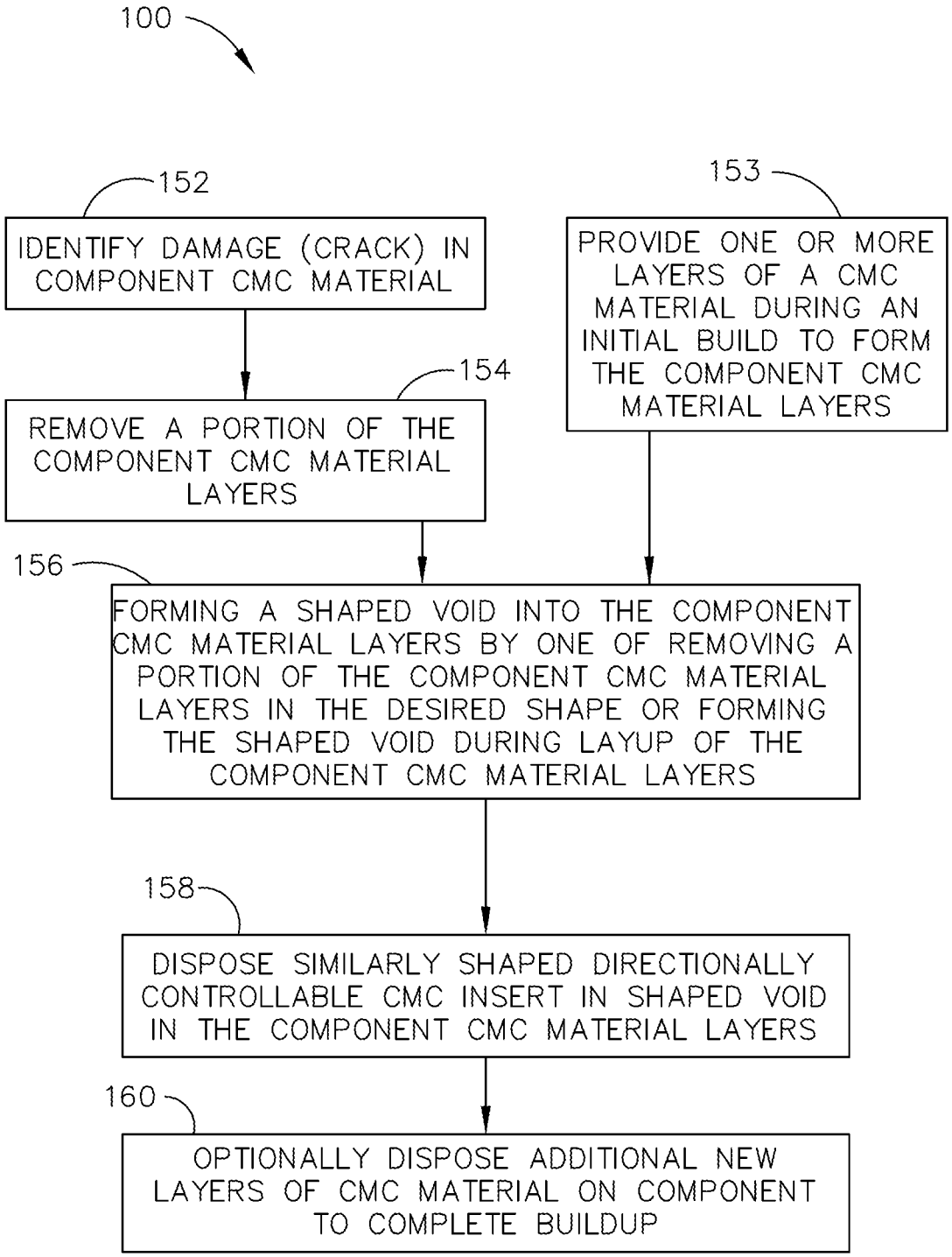
FIG. 13 is a flowchart illustrating the steps in a method of repairing a CMC component including a directionally controllable CMC insert with mechanical interlock, in accordance with one or more embodiments shown or described herein.

Referring more specifically to FIGS. 3 and 13, illustrated is a step in the method 100 of repairing the defect 102, such as a crack, in the CMC component 104 comprised of a plurality of CMC layers 106. More specifically, in an initial step 152 (FIG. 11), the defect 102 is identified in the CMC component 104. Next, in a step 154 (FIG. 11), a portion 108 (illustrated in FIG. 3) of the plurality of CMC material layers 106 that form the CMC component 104 are removed. In an embodiment, the portion 108 of the plurality of CMC material layers 106 is removed by grinding, water jet, electrical discharge, laser machining, etc. In an embodiment, approximately one-third to one-half of the plurality of CMC material layers 106 are removed to prepare the CMC component 104 for repair. The remaining local material layers 110 of the plurality of CMC layers 106, as best illustrated in FIG. 4, include at least a portion of the previously identified defect 102.

In an alternate method of fabrication of a CMC component, a buildup of one or more CMC material layers 112 may be initially formed in a step 153, without the need for initial removal of layers 108.

Figure 5:
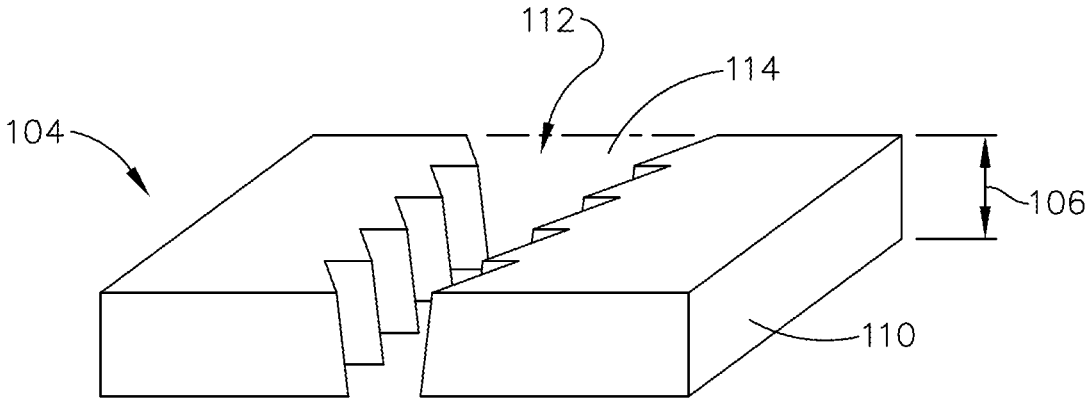
FIG. 5 illustrates a step in a method of repairing a crack with a directionally controllable CMC insert with mechanical interlock, in accordance with one or more embodiments shown or described herein.

Referring now to FIGS. 5 and 13, in a next step 156, a portion of the CMC material layers 112 (FIG. 4) in the remaining plurality of CMC material layers 106 is removed in a desired shape to form a shaped void 114 in the plurality of CMC layers 106. During a repair of a component, in step 156, the defect 102 (FIG. 4) and surrounding damaged component CMC material layers 112 (FIG. 4) in the remaining plurality of CMC material layers 106 are removed in the desired shape to form the shaped void 114 in the plurality of CMC layers 106. In the illustrated embodiment, the shaped void 114 is generally tree-shaped to provide for steering of future crack formations into low crack growth regions (described presently). In an embodiment, the portion of the CMC material layers 112 are removed by water jet, electrical discharge, laser machining, etc. to form the shaped void 114. In a preferred embodiment, the portion of the CMC material layers 112 are removed by laser machining.

Alternatively, in an initial component build described with respect to step 153, the shaped void 114 is formed by either removing a portion of the CMC material layers 112 in the desired shape to form the shaped void 114 in the plurality of CMC layers 106, such as described in step 156, or a shaped void 114 is formed into a portion of the plurality of CMC material layers 106 during the actual layup of the one or more of the plurality of CMC material layers 106.

Figure 6:
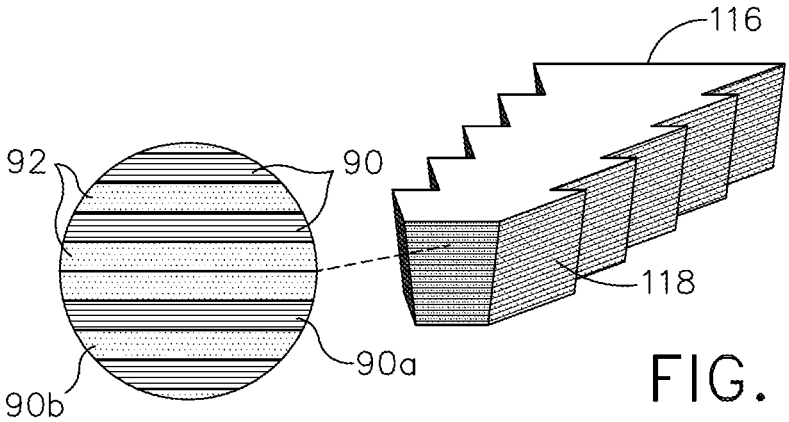
FIG. 6 illustrates a directionally controllable CMC insert, in accordance with one or more embodiments shown or described herein.

As best illustrated in FIG. 6, a directionally controllable CMC insert 116 is provided having a shape to match, or substantially match, that of the shaped void 114. The directionally controllable CMC insert 116 is shaped as such to provide for disposing of the directionally controllable CMC insert 116 therein the portion of the one or more CMC material layers 112 that was previously removed. In an embodiment, the directionally controllable CMC insert 116 and the shaped void 114 are configured within close machining tolerances. More specifically, in an embodiment, the directionally controllable CMC insert 116 and the shaped void 114 are configured within machining tolerances of 50 mils or less, and more particularly within machining tolerances of ±20 mils, and in a specific embodiment within machining tolerances of less than 10 mils.

As illustrated in the blown-out enlargement of FIG. 6, in the embodiments disclosed herein, each of the local material layers 110 and the directionally controllable CMC insert 116 are comprised of a plurality of fibers 90 forming plies 92 oriented in the plane of the respective component so as to provide improved interlocking of the joint with the local material layers 110 (FIG. 7) and minimize joint failure. In the embodiment of FIG. 6, as illustrated the plurality of fibers 90 extend from side to side in a layer 90*a* and into and out of the paper in a layer 90*b*. In the illustrated embodiment, the architecture of the plies 92 is symmetric about a mid-plane of the component. Maintaining symmetry of the component plies 92 helps to minimize any distortion or stresses that may arise due to any differences between 0 degree and 90 degree plies. The illustrated 8-ply panel is illustrated having a typical architecture (0/90/0/90:90/0/90/0), which is symmetric about the mid-plane. In an alternate embodiment, the plies are not symmetric about the mid-plane. In an alternate embodiment, the architecture includes plies oriented in a direction other than 0 or 90 degrees, such as +/−45 degrees, some other angle, or a combination of various angles. In an embodiment, the expected loading direction would require the directionally controllable CMC insert 116 to pull away from the local material layers 110 (FIG. 7) in the lateral direction as oriented in the figures). In an embodiment, the plurality of fibers 90 forming the directionally controllable CMC insert 116 and the local material layers 110 are not connected by fibers as none of the fibers bridge the joint (described presently). In this manner, the joint interface has reduced toughness in the loading direction.

Figure 7:
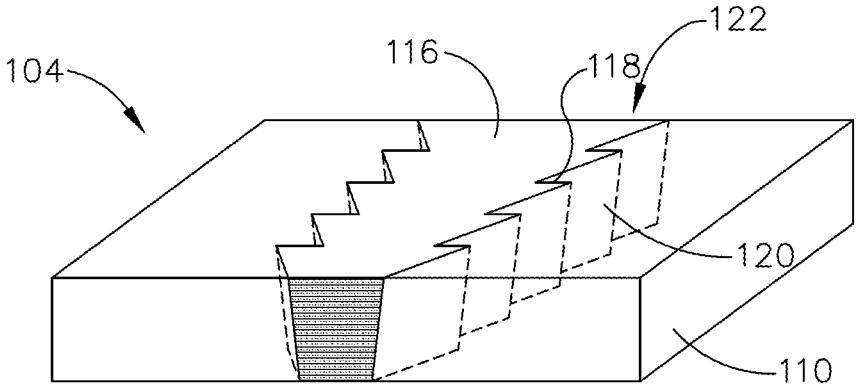
FIG. 7 illustrates a step in a method of repairing a crack with a directionally controllable CMC insert with mechanical interlock, in accordance with one or more embodiments shown or described herein.
Figure 8:
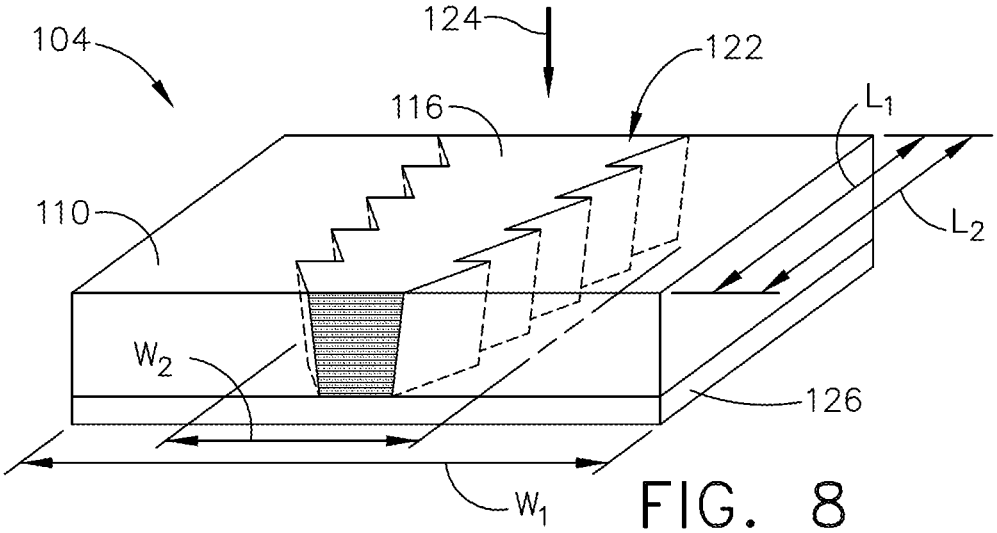
FIG. 8 illustrates a step in a method of repairing a crack with a directionally controllable CMC insert with mechanical interlock, in accordance with one or more embodiments shown or described herein.

Referring now to FIGS. 7 and 13, in a step 158, the directionally controllable CMC insert 116 is disposed within the shaped void 114. As best illustrated in FIG. 7, in this particular embodiment, the directionally controllable CMC insert 116 includes a plurality of side portions 118 that are angled or tapered through the thickness and the shaped void 114 includes a plurality of similar angled side portions 120. The plurality of angled side portions 118 and the plurality of angled side portions 120, when in a mating relationship provide a mechanical interlocking joint 122 between the directionally controllable CMC insert 116 and the shaped void 114. More particularly, the mechanical interlocking joint 122 provides retainment in the through thickness direction of the directionally controllable CMC insert 116 within the shaped void 114 in response to a directional force 124 (FIG. 8). Similarly, the tree shaped insert 116 can be configured such that the side portions 118 are angled with respect to the plane of the plies 92 (FIG. 6) in order to provide a mechanical interlock in a direction within the plane of the insert 116. The plurality of fibers 90 (FIG. 6) do not cross the interface between the insert 116 and the plurality of local material layers 110, so this bond line will have low toughness and as such may be a preferred crack path. Additionally, the architecture of the insert 116 may be optimized to minimize or prevent crack growth through the insert 116. A crack that grows along the interface of the insert 116 and the plurality of CMC layers 119 can thereby be steered by the shape of insert 116 into a low stress region or in a direction unfavorable for crack growth.

As best illustrated in FIGS. 8 and 13, in a step 160, a plurality of layers of CMC material 126 are formed on the remaining layers of the plurality of local materials layers 110 in a manner to span a width "$W_1$" and length"$L_1$" greater than, or at least equal to, an overall width "$W_2$" and length "$L_2$" of the directionally controllable insert 116. In another embodiment, the plurality of local materials layers 110 are disposed in a manner to as to cover a greater area of the CMC component 104 than an overall area of the directionally controllable insert 116. The disposing of the plurality of layers of CMC material 126 provides additional strength to the completed component structure.

Figure 9:
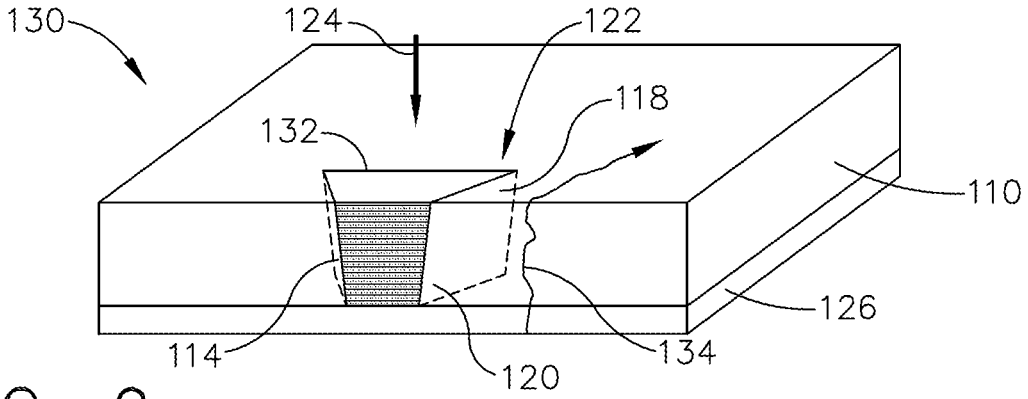
FIG. 9 illustrates another embodiment of a directionally controllable CMC insert with mechanical interlock, in accordance with one or more embodiments shown or described herein.

Referring now to FIGS. 9-12, illustrated are alternate embodiments of a directionally controllable CMC insert, generally similar to the directionally controllable CMC insert 116 of FIGS. 3-8. Unless otherwise indicated, the embodiments of FIGS. 9-12 include the same components identified during the description of the embodiment shown in FIGS. 3-8. Referring more specifically to FIG. 9, illustrated is another embodiment of a CMC component 130 including a directionally controllable CMC insert 132 having a generally dovetail shape. More particularly, similar to the previous embodiment, the directionally controllable CMC insert 132 includes an angled side portion 118 and the shaped void 114 includes a similar angled side portion 120. The angled side portion 118 and the angled side portion 120, when in a mating relationship provide a mechanical interlocking joint 122 between the directionally controllable CMC insert 132 and the shaped void 114. As in the previous embodiment, the mechanical interlocking joint 122 provides retainment of the directionally controllable CMC insert 116 within the shaped void 114 in response to a directional force 124.

As in the previous embodiment, the directionally controllable CMC insert 132 further includes optimized architecture to strengthen high stress regions of the component 130, resulting in reduced likelihood of the reformation of defects, such as cracks. Such optimized architecture may be provided by the orientation of the CMC fibers within the directionally controllable CMC insert 132 and/or component 130, as well as the geometric shape of the directionally controllable CMC insert 132 and/or component 130. The dovetail shape of the directionally controllable CMC insert 132 further provides directional control of any subsequent defects, such as a crack 134, as illustrated. A crack that initiates at the interface of the directionally controllable CMC insert 132 and the plurality of CMC material layers 106 will follow the low toughness bond line and be steered by the shape of the directionally controllable CMC insert 132. If a crack initiates in the plurality of CMC material layers 106 adjacent to the directionally controllable CMC insert 132, and grows into the interface, it will also be steered along the outside perimeter of the directionally controllable CMC insert 132. The uniquely shaped directionally controllable CMC insert 132 provides controlled steering of any potential defects, such as cracks or localized damage, leading the crack growth away from a center of the component 130, where stress is known to be at its greatest, and towards outer regions of low crack growth driving force.

Figure 10:
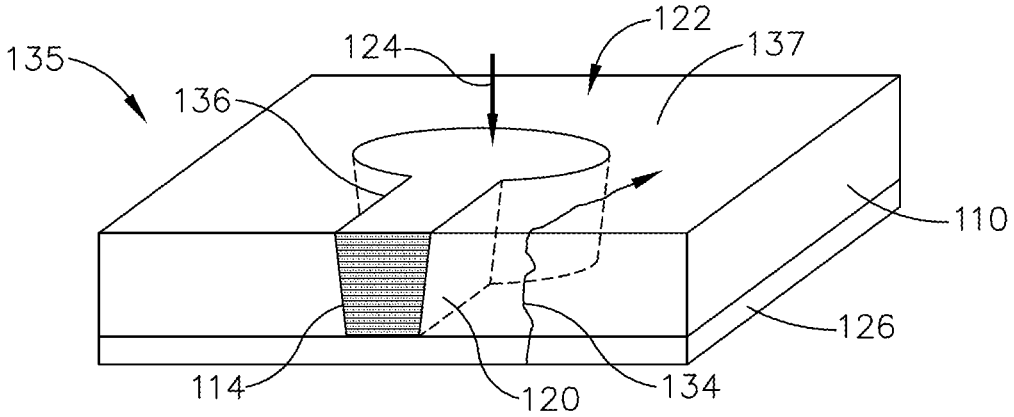
FIG. 10 illustrates another embodiment of a directionally controllable CMC insert with mechanical interlock, in accordance with one or more embodiments shown or described herein.

Referring now to FIG. 10, illustrated is another embodiment of a CMC component 135 including a directionally controllable CMC insert 136 having a generally keyhole shape. Similar to the previous embodiments, the directionally controllable CMC insert 136 includes optimized architecture to strengthen high stress regions of the component 135, resulting in reduced likelihood of the reformation of defects, such as cracks. In addition, the keyhole shape of the directionally controllable CMC insert 136 provides directional control of any subsequent defects, such as a crack 134, as illustrated. The uniquely shaped directionally controllable CMC insert 136 provides steering of any potential defects, such as cracks or localized damage, leading the crack growth away from a center of the component 135 towards regions of low crack growth driving force. Similar to the previous embodiments, the directionally controllable CMC insert 136 is shaped to provide a mechanical interlocking joint 122. The keyhole shape of the directionally controllable CMC insert 136 and the keyhole shape of the shaped void 114, when in a mating relationship provide for the mechanical interlocking joint 122 between the directionally controllable CMC insert 136 and the shaped void 114. The mechanical interlocking joint 122 provides retainment of the directionally controllable CMC insert 136 within the shaped void 114 in response to a directional force 124.

As in the previous embodiments, a plurality of layers of CMC material 126 are formed on the remaining layers of the plurality of local material layers 110 in a manner to span a width "$W_1$" and length"$L_1$" greater than, or at least equal to, an overall width "$W_2$" and length "$L_2$" of the directionally controllable insert 136. In another embodiment, the plurality of local materials layers 110 are disposed in a manner to as to cover a greater area of the CMC component 135 than an overall area of the directionally controllable insert 136.

Figure 11:
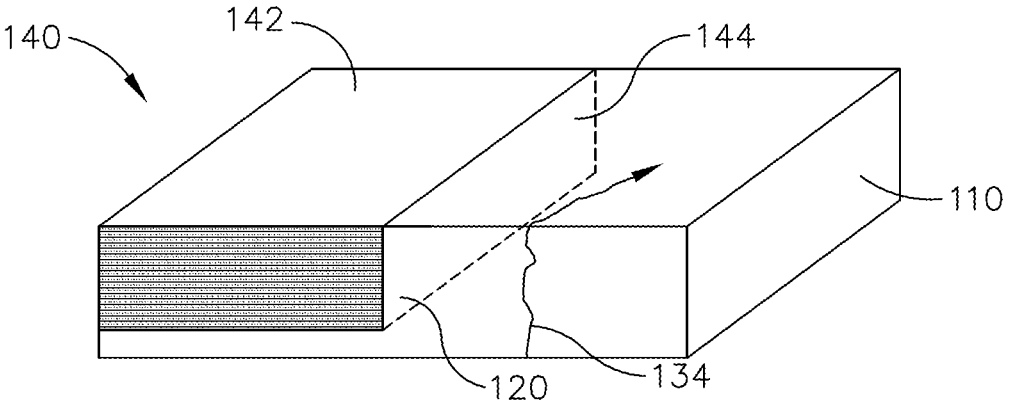
FIG. 11 illustrates another embodiment of a directionally controllable CMC insert, in accordance with one or more embodiments shown or described herein.
Figure 12:
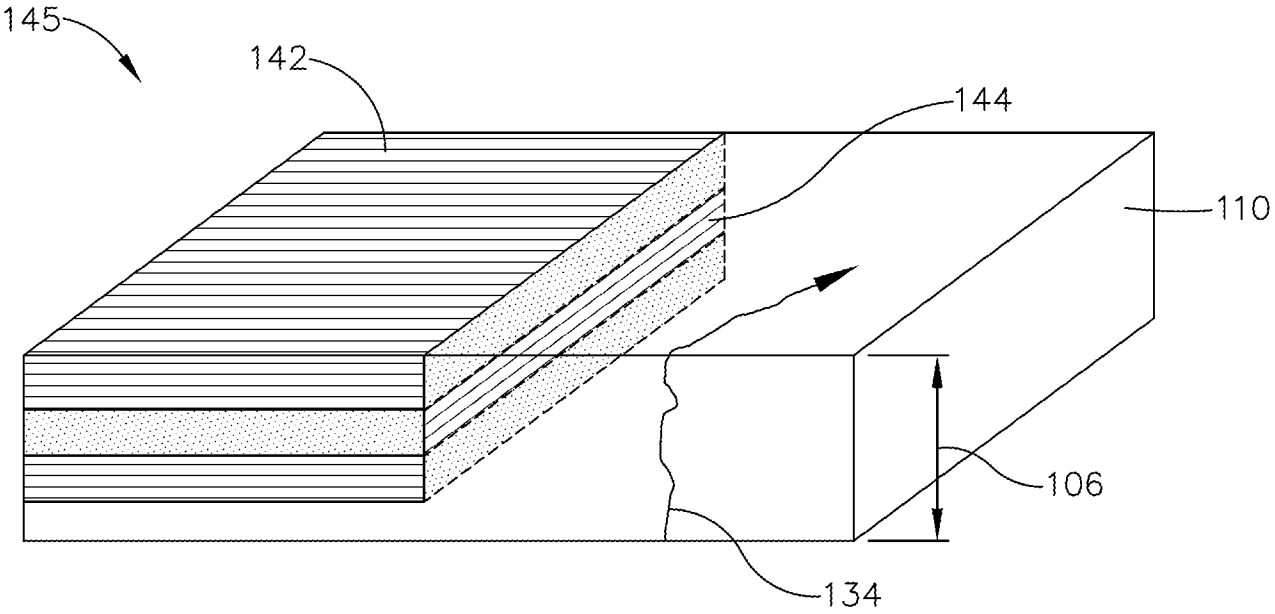
FIG. 12 illustrates another embodiment of a directionally controllable CMC insert, in accordance with one or more embodiments shown or described herein.

FIG. 11 illustrates another embodiment of a CMC component 140 including at least one simplified directionally controllable CMC insert 142 having a generally rectangular shape. Similar to the previous embodiments, the at least one directionally controllable CMC insert 142 includes optimized architecture to strengthen high stress regions of the component 140, resulting in reduced likelihood of the reformation of defects, such as cracks. In addition, the rectangular shape of the at least one directionally controllable CMC insert 142 may provide directional control of any subsequent defects, such as a crack 134, as illustrated. It should be understood that while a specific geometric shape for the directionally controllable CMC insert 142 is illustrated in FIGS. 11 and 12, any number of geometric shapes may be utilized that provides for steering any future crack formation into low crack growth regions of the CMC component. The uniquely shaped at least one directionally controllable CMC insert 142 provides steering of any potential defects, such as cracks or localized damage, leading the crack growth away from a center of the component 140, towards regions of low crack growth driving force. In contrast to the previous embodiments, the at least one directionally controllable CMC insert 142 does not provide a mechanical interlocking joint. In further contrast to the previous embodiments, in this particular embodiment, the at least one directionally controllable CMC insert 142 extends along the local material layers 110 to form a single edge 144 that functions to steer potential crack formations. In an embodiment, the one or more CMC material layers 112 may be formed during layup to include the shaped void 114, as previously described. In addition, while only a single insert is shown in FIG. 11, it is anticipated that multiple directionally controllable CMC inserts 142 may be utilized throughout the thickness of the local material layers 110, and more particularly the plurality of CMC layers 106, as best illustrated in a CMC component 145 of FIG. 12.

At this point it should be understood that the exemplary embodiments provide a system for manufacturing and/or repairing that provides steering cracks in a turbomachine. The system employs a uniquely shaped directionally controllable CMC insert with localized architecture that provides for rejuvenation of local damage in a CMC component. The directionally controllable CMC insert is geometrically configured to redirect or steer potential damage away from high stress or low toughness locations within the CMC component. This approach eliminates the damaged CMC component material, reduces the likeliness of repeat damage and reduces overall life cycle costs. The disposing of the directionally controllable CMC insert within the CMC component can be done in the prepreg, laminated, pyrolyzed, or fully densified state of the CMC materials.

The directionally controllable CMC insert is formed from well-known CMC materials that are designed to withstand high temperature applications. It should also be understood, that while the directionally controllable CMC insert is shown and described as having a specific geometric shape, the geometry of the directionally controllable CMC insert may vary and include any additional shapes that may not be disclosed herein, but capable or redirecting and/or steering potential damage away for high stress or low toughness locations within the CMC component.

While the disclosure has been described in detail in connection with only a limited number of embodiments, it should be readily understood that it is not limited to such disclosed embodiments. Rather, the embodiments can be modified to incorporate any number of variations, alterations, substitutions or equivalent arrangements not heretofore described, but which are commensurate with the spirit and scope of the disclosure. Additionally, while various embodiments have been described, it is to be understood that aspects of the invention may include only some of the described embodiments. Accordingly, the disclosure is not to be seen as limited by the foregoing description, but is only limited by the scope of the appended claims.

What is claimed is:

1. A ceramic matrix composite (CMC) component comprising:

a plurality of CMC layers, at least one of the plurality of CMC layers defining a first plane; and a CMC insert disposed in the plurality of CMC layers, the CMC insert comprising:

a plurality of plies, wherein the plurality of plies includes at least a first ply including a first plurality of fibers oriented in a first direction and at least a second ply including a second plurality of fibers oriented in a second direction, the first direction and the second direction defining a third direction that is orthogonal to both the first direction and the second direction; and a joint interface between the CMC insert and at least one of the plurality of CMC layers, the CMC insert being geometrically configured and disposed within the plurality of CMC layers such that the first plurality of fibers of the at least first ply of the plurality of plies of the CMC insert is oriented in the first plane defined by the at least one of the plurality of CMC layers, wherein the CMC insert comprises a side portion, wherein the side portion is angled with respect to the first plane and is angled with respect to a second plane that is defined by the third direction and is defined by the first direction or the second direction, and wherein an architecture of the plurality of plies of the CMC insert is symmetric about a mid-plane of the CMC component, the mid-plane being parallel to the first plane and the mid-plane being between two plies with a substantially identical orientation.

2. The CMC component according to claim 1, wherein the plurality of CMC layers comprise a shaped void, the CMC insert disposed within the shaped void.

3. The CMC component according to claim 2, wherein a geometric shape of the CMC insert and a geometric shape of the shaped void are configured within machining tolerances of 50 mils or less.

4. The CMC component according to claim 2, wherein the shaped void and the CMC insert are geometrically configured to form a mechanical interlocking joint therebetween.

5. The CMC component according to Claim 1, wherein the first plane defines a shape of the CMC insert, the shape being at least one of a dovetail shape or a keyhole shape.

6. The CMC component according to claim 1, wherein the CMC component comprises one of a combustor liner, a shroud, a turbine center frame, a turbine blade, or a turbine vane.

7. The CMC component according to claim 1, wherein the plurality of plies of the CMC insert includes a top ply and a bottom ply, and wherein the joint interface extends continuously from the bottom ply to the top ply.

8. The CMC component according to claim 1, wherein the first plane defines a shape of the CMC insert, the shape being tree-shaped such that the shape includes a plurality of stacked isosceles trapezoids comprising non-90 degree angles between sides, wherein the plurality of stacked isosceles trapezoids progressively decrease in size.

9.

The CMC component according to claim 8, wherein a third plane that is orthogonal to the first plane defines a second shape of the CMC insert, the second shape being a dovetail shape.

10. A turbomachine comprising:

a CMC component comprised of a plurality of CMC material layers, the CMC component including a shaped void contained therein the plurality of CMC material layers, wherein at least one of the plurality of CMC material layers define a first plane; and a CMC insert defining a width and a length, the length longer than the width, the CMC insert disposed within the shaped void, the CMC insert including a plurality of plies, wherein the plurality of plies include at least a first ply including a first plurality of fibers oriented in a first direction and at least a second ply including a second plurality of fibers oriented in a second direction, and a joint interface between the CMC insert and the plurality of CMC material layers, wherein the first direction and the second direction define a third direction that is orthogonal to both the first direction and the third direction, wherein the shaped void and the CMC insert are geometrically configured and oriented with respect to each other such that the first plurality of fibers of the at least first ply of the plurality of plies of the CMC insert is oriented in the first plane with at least one of the plurality of CMC material layers of the CMC component to form a mechanical interlocking joint therebetween, wherein the CMC insert comprises a side portion, wherein the side portion is angled with respect to the first plane and is angled with respect to a second plane that is defined by the third direction and is defined by the first direction or the second direction and wherein an architecture of the plurality of plies of the CMC insert is symmetric about a mid-plane of the CMC component, the mid-plane being parallel to the first plane and the mid- plane being between two plies with a substantially identical orientation.

11. The turbomachine according to claim 10, wherein the first plane defines a shape of the CMC insert, the shape being at least one of a dovetail shape or a keyhole shape.

12. The turbomachine according to claim 10, wherein the CMC component comprises one of a combustor liner, a shroud, a turbine center frame, a turbine blade or a turbine vane.

13. The turbomachine of claim 10, wherein the first plane defines a shape of the CMC insert, the shape being tree-shaped such that the shape includes a plurality of stacked isosceles trapezoids comprising non-90 degree angles between sides, wherein the plurality of stacked isosceles trapezoids progressively decrease in size.

14.

The turbomachine of claim 13, wherein a third plane that is orthogonal to the first plane defines a second shape of the CMC insert, the second shape being a dovetail shape.

15. A method of forming a turbomachine member, the method comprising:

forming a shaped void in a portion of a plurality of CMC material layers in a shape, wherein at least one of the plurality of CMC material layers defines a first plane; and disposing a CMC insert into the shaped void formed in the plurality of CMC material layers, the CMC insert including a plurality of plies, wherein the plurality of plies includes at least a first ply including a first plurality of fibers oriented in a first direction, and at least a second ply including a second plurality of fibers oriented in a second direction, wherein the CMC insert is geometrically shaped to form a joint interface with the shaped void, wherein the first direction and the second direction define a third direction that is orthogonal to both the first direction and the third direction, wherein the CMC insert is geometrically configured and disposed within the turbomachine member such that the first plurality of fibers of the first ply of the plurality of plies of the CMC insert is oriented in the first plane with at least one of the plurality of CMC material layers, wherein the CMC insert comprises a side portion, wherein the side portion is angled with respect to the first plane and is angled with respect to a second plane that is defined by the third direction and is defined by the first direction or the second direction and wherein an architecture of the plurality of plies of the CMC insert is symmetric about a mid-plane of the turbomachine member, the mid-plane being parallel to the first plane and the mid-plane being between two plies with a substantially identical orientation.

16. The method according to claim 15, further comprising disposing a plurality of new CMC material layers on the plurality of CMC material layers including the CMC insert.

17. The method according to claim 15, further comprising initially identifying a defect in the plurality of CMC material layers of the turbomachine member to provide repair of the turbomachine member.

18. The method according to claim 15, wherein the turbomachine member is a new build.

19.

The method according to claim 15, wherein the CMC insert is shaped to form a mechanical interlocking joint with the portion of the plurality of CMC material layers about a perimeter of the CMC insert, wherein the first plane defines a shape of the CMC insert, the shape being at least one of a dovetail shape or a keyhole shape.

* * * * *